US012760917B2

(12) United States Patent
Miyazaki et al.

(10) Patent No.: US 12,760,917 B2
(45) Date of Patent: Oct. 13, 2026

(54) VENTILATION SYSTEM

(71) Applicant: DAIKIN INDUSTRIES, LTD., Osaka (JP)

(72) Inventors: Takeru Miyazaki, Osaka (JP); Yoshiki Yamanoi, Osaka (JP); Yuta Iyoshi, Osaka (JP); Kumiko Saeki, Osaka (JP); Masashi Saito, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 142 days.

(21) Appl. No.: 18/742,652

(22) Filed: Jun. 13, 2024

(65) Prior Publication Data

US 2024/0328648 A1 Oct. 3, 2024

Related U.S. Application Data

(63) Continuation of application No. PCT/JP2022/040691, filed on Oct. 31, 2022.

(30) Foreign Application Priority Data

Dec. 17, 2021 (JP) ..... 2021-205442

(51) Int. Cl.
*F24F 11/00* (2018.01)
*F24F 7/00* (2021.01)
*F24F 11/32* (2018.01)

(52) U.S. Cl.
CPC ..... *F24F 11/0001* (2013.01); *F24F 7/00* (2013.01); *F24F 11/32* (2018.01)

(58) Field of Classification Search
CPC ..... F24F 11/0001; F24F 7/00; F24F 11/32; F24F 12/003; F24F 11/38; F24F 11/86;
(Continued)

(56) References Cited

U.S. PATENT DOCUMENTS

2005/0165577 A1* 7/2005 Fasullo ..... G06F 1/206 702/142
2010/0252642 A1 10/2010 Matsui et al.

FOREIGN PATENT DOCUMENTS

CN 105757799 A * 7/2016 ..... F24F 11/70
CN 108518793 A * 9/2018 ..... F24F 11/32
(Continued)

OTHER PUBLICATIONS

International Preliminary Report of corresponding PCT Application No. PCT/JP2022/040691 dated Jun. 27, 2024.
(Continued)

*Primary Examiner* — Kun Kai Ma
(74) *Attorney, Agent, or Firm* — Spencer Fane LLP

(57) ABSTRACT

A ventilation system includes a refrigerant circuit, supply and exhaust fans, and a control unit. The refrigerant circuit has a compressor and first and second heat exchangers connected by a refrigerant pipe with a refrigerant flowing in the refrigerant circuit. The supply fan is arranged to supply air from an outdoor space to an indoor space through the first heat exchanger. The exhaust fan is arranged to exhaust air in the indoor space to the outdoor space through the second heat exchanger. The control unit determines whether the supply fan and the exhaust fan are normal. The control unit, upon determining that one of the supply fan or the exhaust fan is abnormal, stops the one of the supply fan or the exhaust fan determined to be abnormal, and continues an operation of an other one of the supply fan or the exhaust fan determined to be normal.

9 Claims, 7 Drawing Sheets

(58) Field of Classification Search
CPC ... F05D 2260/85; F04D 25/166; F04D 27/004
See application file for complete search history.

(56) References Cited

FOREIGN PATENT DOCUMENTS

| | | | | | |
|---|---|---|---|---|---|
| CN | 110513826 | A | * | 11/2019 | ..... F24F 11/38 |
| EP | 2 955 452 | A1 | | 12/2015 | |
| JP | 3-20573 | A | | 1/1991 | |
| JP | 11-132512 | A | | 5/1999 | |
| JP | 2001-289493 | A | | 10/2001 | |
| JP | 2005-291586 | A | | 10/2005 | |
| JP | 2006-275431 | A | | 10/2006 | |
| JP | 2012-60701 | A | | 3/2012 | |
| JP | 2013-137000 | A | | 7/2013 | |
| JP | 2015-108468 | A | | 6/2015 | |
| JP | 2017054604 | A | * | 3/2017 | |
| JP | 2020008224 | A | * | 1/2020 | |
| JP | 2021-55922 | A | | 4/2021 | |
| KR | 20080105628 | A | * | 12/2008 | ..... H04Q 1/035 |
| WO | 2017/017846 | A1 | | 2/2017 | |

OTHER PUBLICATIONS

International Search Report of corresponding PCT Application No. PCT/JP2022/040691 dated Dec. 27, 2022.
European Search Report of corresponding EP Application No. 22 90 7063.6 dated Feb. 11, 2025.

* cited by examiner

VENTILATION SYSTEM

CROSS-REFERENCE TO RELATED APPLICATIONS

This is a continuation of International Application No. PCT/JP2022/040691 filed on Oct. 31, 2022, which claims priority to Japanese Patent Application No. 2021-205442, filed on Dec. 17, 2021. The entire disclosures of these applications are incorporated by reference herein.

BACKGROUND

Technical Field

The present disclosure relates to a ventilation system.

Background Art

Conventionally, there is known an air conditioning system including a refrigerant circuit in which a refrigerant flows and a heat source-side unit including a compressor, a plurality of utilization-side units that air-conditions an indoor space, a supply unit including a supply fan and a first heat exchanger, and an exhaust unit including an exhaust fan and a second heat exchanger are connected by a refrigerant pipe (see, for example, Japanese Laid-Open Patent Publication No. H3-20573). The air conditioning system can ventilate the indoor space by the supply fan and the exhaust fan.

SUMMARY

A ventilation system of the present disclosure includes a refrigerant circuit in which a compressor, a first heat exchanger, and a second heat exchanger are connected by a refrigerant pipe and a refrigerant flows inside, a supply fan that supplies air from an outdoor space to an indoor space through the first heat exchanger, an exhaust fan that exhausts air in the indoor space to the outdoor space through the second heat exchanger, and a control unit, in which the control unit determines whether the supply fan and the exhaust fan are normal, and when determining that one of the supply fan or the exhaust fan is abnormal, the control unit stops the one of the supply fan or the exhaust fan determined to be abnormal and continues an operation of another one of the supply fan or the exhaust fan determined to be normal.

DETAILED DESCRIPTION OF EMBODIMENT(S)

Outline of Ventilation System

Figure 1:
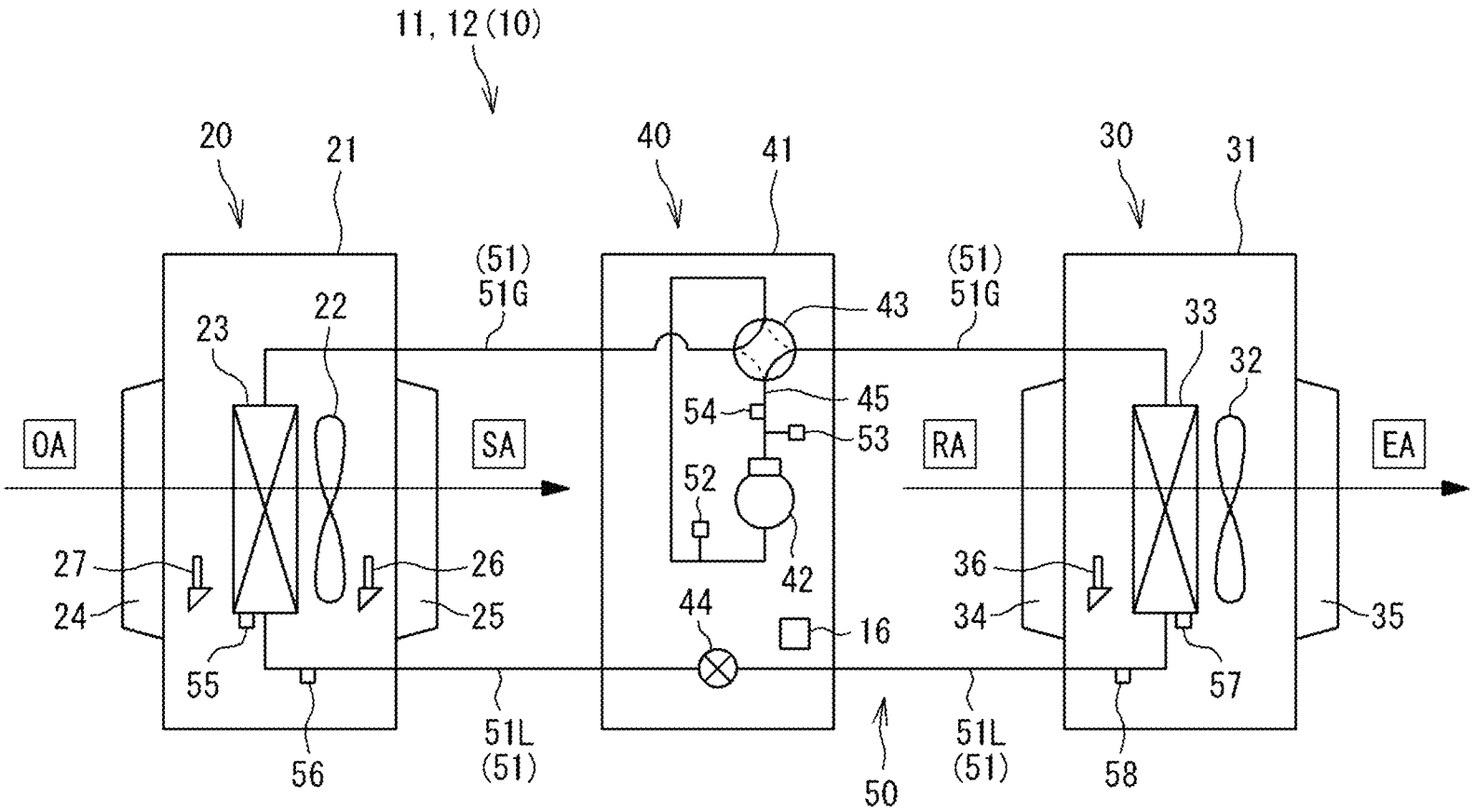
FIG. 1 is a schematic configuration diagram of a ventilation system of the present disclosure.
Figure 2:
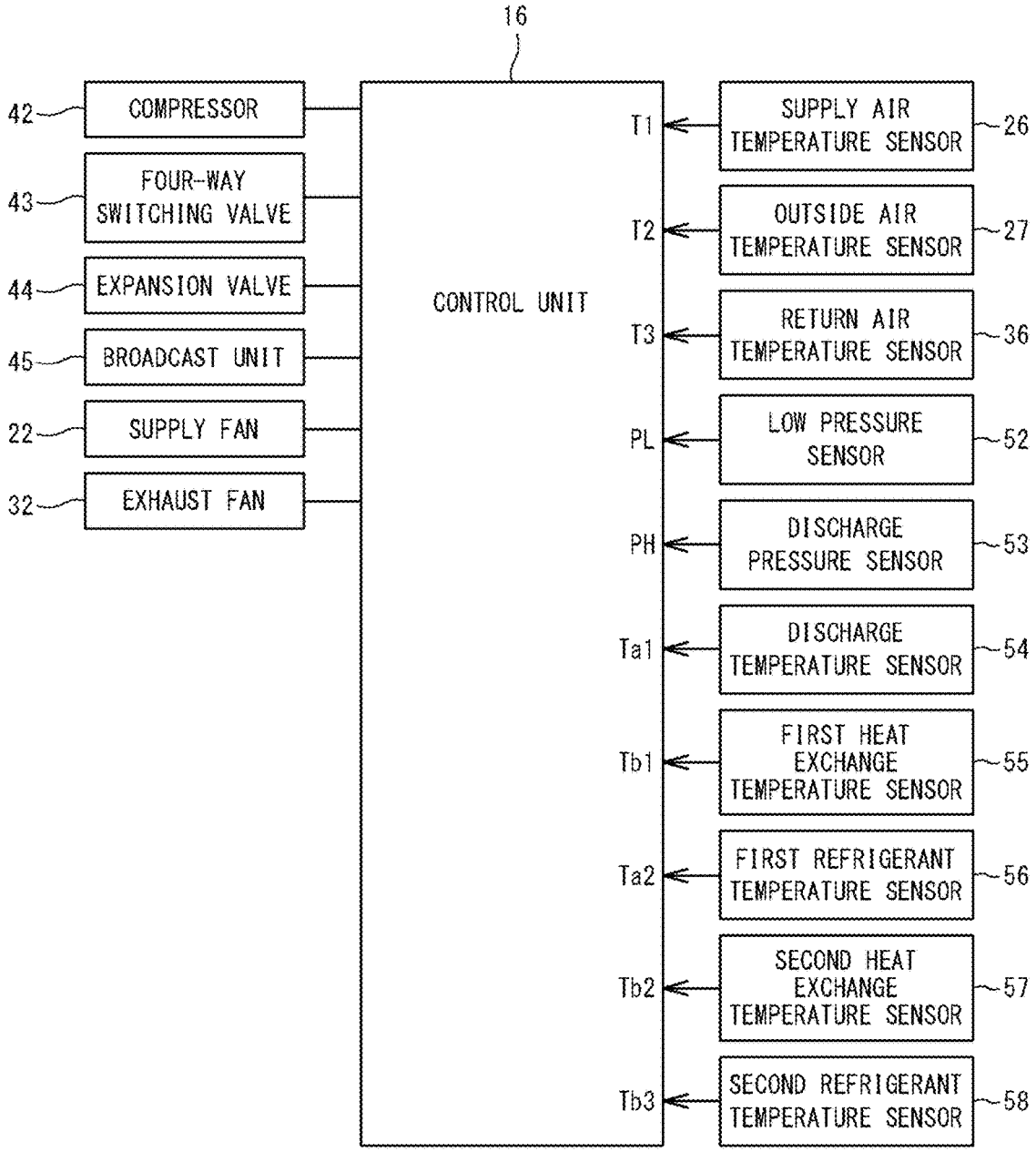
FIG. 2 is a control block diagram of the ventilation system of the present disclosure.

FIG. 1 is a schematic configuration diagram of a ventilation system of the present disclosure. FIG. 2 is a control block diagram of the ventilation system of the present disclosure. In the following description, a ventilation system 10 according to a first embodiment (see FIG. 5 and FIG. 6) is referred to as a first ventilation system 11, and a ventilation system 10 according to a second embodiment (see FIG. 7) is referred to as a second ventilation system 12. In the following description, when simply referred to as the "ventilation system 10", the configuration common to the first ventilation system 11 and the second ventilation system 12 will be described.

The ventilation system 10 of the present disclosure illustrated in FIG. 1 is installed on a building such as an office building or a factory, and achieves ventilation of a target space in the building. The ventilation system 10 includes a supply unit 20, an exhaust unit 30, a compressor unit 40, and a refrigerant circuit 50.

As shown in FIG. 1, the supply unit 20 includes a first casing 21, a supply fan 22, and a first heat exchanger 23. The first casing 21 according to the present embodiment is a cubic box constituted with a panel member having a heat insulating property, and has side surfaces provided with a suction port 24 and a blow-out port 25. The supply fan 22 and the first heat exchanger 23 are disposed in the first casing 21. When the supply fan 22 is driven, the supply unit 20 takes air (outside air OA) in an outdoor space (hereinafter, referred to as an outdoor space S2, see FIG. 5 and FIG. 7) into the first casing 21, exchanges heat of the taken air with a refrigerant in the first heat exchanger 23, and then supplies the air (supply air SA) from the blow-out port 25 toward an indoor space (hereinafter, referred to as an indoor space S1, see FIG. 5 and FIG. 7).

The first heat exchanger 23 constitutes the refrigerant circuit 50 described later. The first heat exchanger 23 is a cross-fin tube type or microchannel type heat exchanger, and is used to exchange heat between the refrigerant flowing in the first heat exchanger 23 and the air (outside air OA) in the outdoor space S2.

The supply unit 20 includes a supply air temperature sensor 26 and an outside air temperature sensor 27. The supply air temperature sensor 26 is disposed in an airflow after passing through the first heat exchanger 23 in the first casing 21, and detects a temperature T1 of the supply air SA (hereinafter, referred to as a blow-out air temperature T1). The outside air temperature sensor 27 is disposed in an airflow before passing through the first heat exchanger 23 in the first casing 21, and detects a temperature T2 of the outside air OA (hereinafter, referred to as an outside air temperature T2).

The supply unit 20 includes a first heat exchange temperature sensor 55 and a first refrigerant temperature sensor 56. The first heat exchange temperature sensor 55 detects a temperature Tb1 of the first heat exchanger 23 (in other words, of the refrigerant in the first heat exchanger 23). The first refrigerant temperature sensor 56 detects a temperature Ta2 of the refrigerant after passing through (an outlet of) the first heat exchanger 23. The first heat exchange temperature sensor 55 may be a pressure sensor that detects a pressure in the first heat exchanger 23. In this case, the refrigerant temperature in the first heat exchanger 23 is converted from a detection value of the pressure.

The exhaust unit 30 includes a second casing 31, an exhaust fan 32, and a second heat exchanger 33. The second casing 31 according to the present embodiment is a cubic box constituted with a panel member having a heat insulating property, and has side surfaces provided with a suction port 34 and a blow-out port 35. The exhaust fan 32 and the second heat exchanger 33 are disposed in the second casing 31. When the exhaust fan 32 is driven, the exhaust unit 30 takes air (return air RA) in the indoor space S1 into the second casing 31, exchanges heat of the taken air with a refrigerant in the second heat exchanger 33, and then releases the air (exhaust air EA) from the blow-out port 35 toward the outdoor space S2.

The second heat exchanger 33 constitutes the refrigerant circuit 50 described later. The second heat exchanger 33 is a cross-fin tube type or microchannel type heat exchanger, and is used to exchange heat between the refrigerant flowing in the second heat exchanger 33 and the air (return air RA) in the indoor space S1.

The exhaust unit 30 includes a return air temperature sensor 36. The return air temperature sensor 36 is disposed in an airflow before passing through the second heat exchanger 33 in the second casing 31, and detects a temperature T3 of the air flowing into the second heat exchanger 33. In the following description, the temperature T3 is referred to as a suction air temperature T3.

The exhaust unit 30 includes a second heat exchange temperature sensor 57 and a second refrigerant temperature sensor 58. The second heat exchange temperature sensor 57 detects a temperature Tb2 of the second heat exchanger 33 (in other words, of the refrigerant in the second heat exchanger 33). The second refrigerant temperature sensor 58 detects a temperature Tb3 of the refrigerant after passing through (an outlet of) the second heat exchanger 33. The second heat exchange temperature sensor 57 may be a pressure sensor that detects a pressure in the second heat exchanger 33. In this case, the refrigerant temperature in the first heat exchanger 23 is converted from a detection value of the pressure.

As described above, the ventilation system 10 of the present disclosure includes the supply fan 22 and the exhaust fan 32. Although the ventilation system 10 illustrated in FIG. 1 includes one supply fan 22 and one exhaust fan 32, in the ventilation system 10 of the present disclosure, the number of supply fans 22 may be two or more, and the number of exhaust fans 32 may be two or more.

The compressor unit 40 includes a third casing 41, a compressor 42, a four-way switching valve 43, and an expansion valve 44. Although the compressor unit 40 according to the present embodiment includes the third casing 41, the third casing 41 may be omitted. In this case, the compressor 42 and the four-way switching valve 43 are preferably accommodated in the first casing 21 of the supply unit 20 or the second casing 31 of the exhaust unit 30. Although the expansion valve 44 is accommodated in the compressor unit 40 in the ventilation system 10 according to the present embodiment, the expansion valve 44 may be accommodated in the first casing 21 of the supply unit 20 or the second casing 31 of the exhaust unit 30.

The compressor unit 40 includes a low pressure sensor 52, a discharge pressure sensor 53, and a discharge temperature sensor 54. The low pressure sensor 52 detects a pressure PL of the refrigerant sucked into the compressor 42. In the following description, the pressure PL is also referred to as a low pressure PL. The discharge pressure sensor 53 detects a pressure PH of the refrigerant discharged from the compressor 42. In the following description, the pressure PH is also referred to as a high pressure PH. The discharge temperature sensor 54 detects a temperature Ta1 of the refrigerant discharged from the compressor 42.

The compressor 42 sucks a low-pressure gaseous refrigerant and discharges a high-pressure gaseous refrigerant. The compressor 42 includes a motor having the number of operating revolutions adjustable in accordance with inverter control. The compressor 42 is of a variable capacity type (performance variable type) having capacity (performance) variable in accordance with inverter control of the motor. Alternatively, the compressor 42 may be of a constant capacity type. The compressor 42 used in the ventilation system 10 of the present disclosure may be configured by connecting two or more compressors in parallel.

The four-way switching valve 43 reverses the flow of refrigerant in the refrigerant pipe, and switches and supplies the refrigerant discharged from the compressor 42 to either the first heat exchanger 23 or the second heat exchanger 33. Accordingly, the ventilation system 10 can switch between a cooling operation of cooling the outside air OA and a heating operation of heating the outside air OA. The expansion valve 44 is constituted by an electric valve capable of adjusting the flow rate and the pressure of the refrigerant. In the ventilation system 10, an opening degree of the expansion valve 44 is controlled to adjust the pressure of the refrigerant to be supplied to the first heat exchanger 23 or the second heat exchanger 33.

The refrigerant circuit 50 includes the compressor 42, the four-way switching valve 43, the expansion valve 44, the first heat exchanger 23, the second heat exchanger 33, and a refrigerant pipe 51 (a liquid pipe 51L and a gas pipe 51G) connecting the above components. The refrigerant circuit 50 circulates the refrigerant between the first heat exchanger 23 and the second heat exchanger 33.

In the ventilation system 10 having the above configuration, when the outside air OA is cooled and supplied by the air supply unit 20, the four-way switching valve 43 is held in a state indicated by solid lines in FIG. 1. The high-temperature and high-pressure gaseous refrigerant discharged from the compressor 42 flows into the second heat exchanger 33 of the exhaust unit 30 through the four-way switching valve 43. At this time, the second heat exchanger 33 functions as a condenser, and the refrigerant exchanges heat with the return air RA by the activation of the exhaust fan 32 to be condensed and liquefied. The liquefied refrigerant is decompressed by the expansion valve 44 and flows into the first heat exchanger 23. At this time, the first heat exchanger 23 functions as an evaporator, and in the first heat exchanger 23, the refrigerant exchanges heat with the outside air OA and evaporates. The outside air OA cooled by the evaporation of the refrigerant is supplied to the indoor space S1 as the supply air SA by the supply fan 22. The refrigerant evaporated in the first heat exchanger 23 returns to the compressor unit 40 through the refrigerant pipe 51 (gas pipe 51G), and is sucked into the compressor 42 through the four-way switching valve 43.

In the ventilation system 10 having the above configuration, when the outside air OA is heated and supplied by the supply unit 20, the four-way switching valve 43 is held in a state indicated by broken lines in FIG. 1. The high-temperature and high-pressure gaseous refrigerant discharged from the compressor 42 passes through the four-way switching valve 43 and flows into the first heat exchanger 23 of the supply unit 20. At this time, the first heat exchanger 23 functions as a condenser, and the refrigerant exchanges heat with the outside air OA to be condensed and liquefied in the first heat exchanger 23. The outside air OA heated by the condensation of the refrigerant is supplied to the indoor space S1 by the supply fan 22. The refrigerant liquefied in the first heat exchanger 23 reaches the compressor unit 40 through the refrigerant pipe 51 (liquid pipe 51L), is decompressed to a predetermined low pressure by the expansion valve 44, and further flows into the second heat exchanger 33. At this time, the second heat exchanger 33 functions as an evaporator, and the refrigerant exchanges heat with the return air RA and evaporates in the second heat exchanger 33. The refrigerant evaporated and vaporized in the second heat exchanger 33 is sucked into the compressor 42 through the four-way switching valve 43.

In the ventilation system 10 according to the present embodiment, the refrigerant circuit 50 includes the four-way switching valve 43, and the first heat exchanger 23 can be switched and used as an evaporator and a condenser by the four-way switching valve 43. Alternatively, the four-way switching valve 43 in the ventilation system 10 may be omitted. In this case, the first heat exchanger 23 can be used as an evaporator or a condenser.

Control Unit

FIG. 2 is a control block diagram illustrating the ventilation system 10. As illustrated in FIG. 2, the ventilation system 10 includes a control unit 16. The control unit 16 is configured to control an operation of the ventilation system 10, and is constituted by, for example, a microcomputer including a processor such as a CPU and a memory such as a RAM or a ROM. The control unit 16 may be implemented as hardware with use of an LSI, an ASIC, an FPGA, or the like. The control unit 16 exerts a predetermined function when the processor executes a program installed in the memory.

The control unit 16 is connected to the air supply fan 22, the exhaust fan 32, the compressor 42, the four-way switching valve 43, the expansion valve 44, and a notification unit 45. The control unit 16 is connected to the supply air temperature sensor 26, the outside air temperature sensor 27, and the return air temperature sensor 36.

The control unit 16 is connected to the low pressure sensor 52, the discharge pressure sensor 53, the discharge temperature sensor 54, the first heat exchange temperature sensor 55, the first refrigerant temperature sensor 56, the second heat exchange temperature sensor 57, and the second refrigerant temperature sensor 58 provided at various locations in the refrigerant circuit 50. In the present description, detection values of the sensors 52 to 58 provided in the refrigerant circuit 50 are also referred to as state values of the refrigerant circuit 50. The control unit 16 knows an operation state of the refrigerant circuit 50 on the basis of the state values of the refrigerant circuit 50. Specifically, for example, when the outside air OA is heated in their supply unit 20 to supply air, the control unit 16 calculates a saturation temperature TS of the second heat exchanger 33 functioning as an evaporator on the basis of the detection value (high pressure PH) of the discharge pressure sensor 53, acquires the low pressure PL of the refrigerant circuit 50 from the detection value of the low pressure sensor 52, and acquires an evaporation temperature TE of the second heat exchanger 33 from the detection value (temperature Tb2) of the second heat exchange temperature sensor 57. The saturation temperature TS, the low pressure PL, and the evaporation temperature TE are examples of the state values of the refrigerant circuit 50.

The control unit 16 stores a threshold for determining whether each state value of the refrigerant circuit 50 is normal or abnormal. When the acquired state value exceeds the threshold, the control unit 16 determines that the refrigerant circuit 50 has reached a state in which a function of the refrigerant circuit 50 cannot be maintained. In the present description, the state in which the refrigerant circuit 50 cannot maintain the function of the refrigerant circuit 50 is also referred to as "the state value of the refrigerant circuit 50 exceeds an allowable range".

The control unit 16 is configured to be able to individually acquire information related to operation current values and numbers of fan rotations of the supply fan 22 and the exhaust fan 32. The control unit 16 determines whether the supply fan 22 is normal on the basis of a correlation between the number of fan rotations and the operation current value of the supply fan 22, and determines whether the exhaust fan 32 is normal on the basis of a correlation between the number of fan rotations and the operation current value of the exhaust fan 32. The ventilation system 10 having such a configuration allows the control unit 16 to determine whether the supply fan 22 or the exhaust fan 32 is normal by without a sensor provided separately.

The control unit 16 has a function of determining whether there is a sign of abnormality occurring in the supply fan 22 and the exhaust fan 32 on the basis of information related to the individual operation current values and numbers of fan rotations of the supply fan 22 and the exhaust fan 32. For example, the control unit 16 determines whether there is a sign of abnormality occurrence on the basis of the operation current values at a time of starting the supply fan 22 and the exhaust fan 32 and the correlation between the operation current values and the numbers of fan rotations of the supply fan 22 and the exhaust fan 32.

Notification Unit

The notification unit 45 according to the present embodiment is a remote controller for a user to operate and stop the ventilation system 10, change settings of the ventilation system 10, and the like, and is disposed in the target space (indoor space S1) where ventilation is performed by the ventilation system 10. The notification unit 45 notifies occurrence of an abnormality in the ventilation system 10 by a sound (including buzzer sound, voice, or the like) or a display (including lighting of a lamp, display by a liquid crystal panel, or the like). In the present embodiment, the remote controller for the ventilation system 10 also serves as the notification unit 45, but the notification unit 45 may be configured by a device other than the remote controller. The place where notification unit 45 is disposed is not required to be the indoor space S1, and may be, for example, a place where an administrator of the ventilation system 10 is present (central monitoring room).

Figure 3:
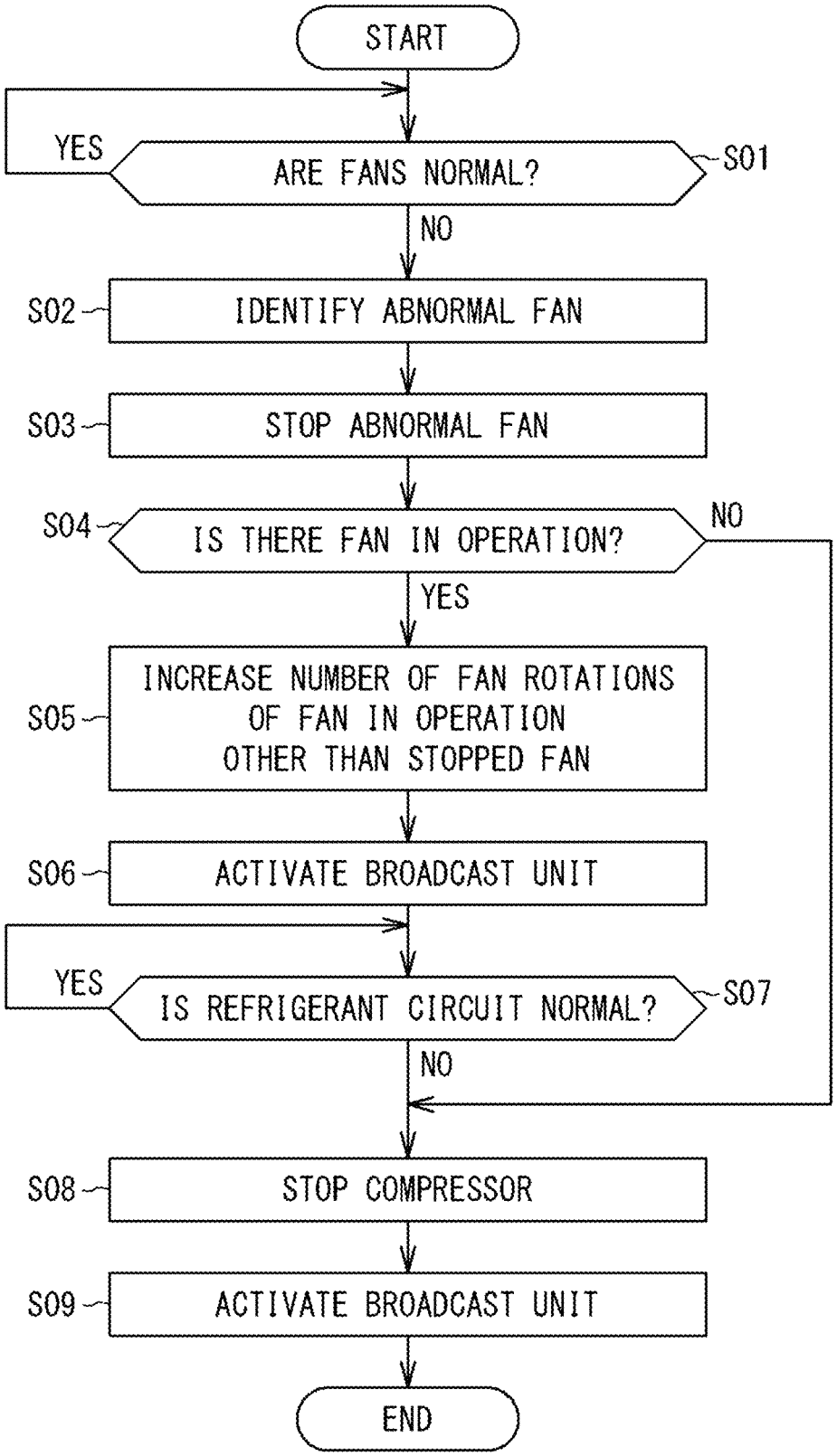
FIG. 3 is a first flowchart illustrating an operation when an abnormality occurs in the ventilation system of the present disclosure.
Figure 4:
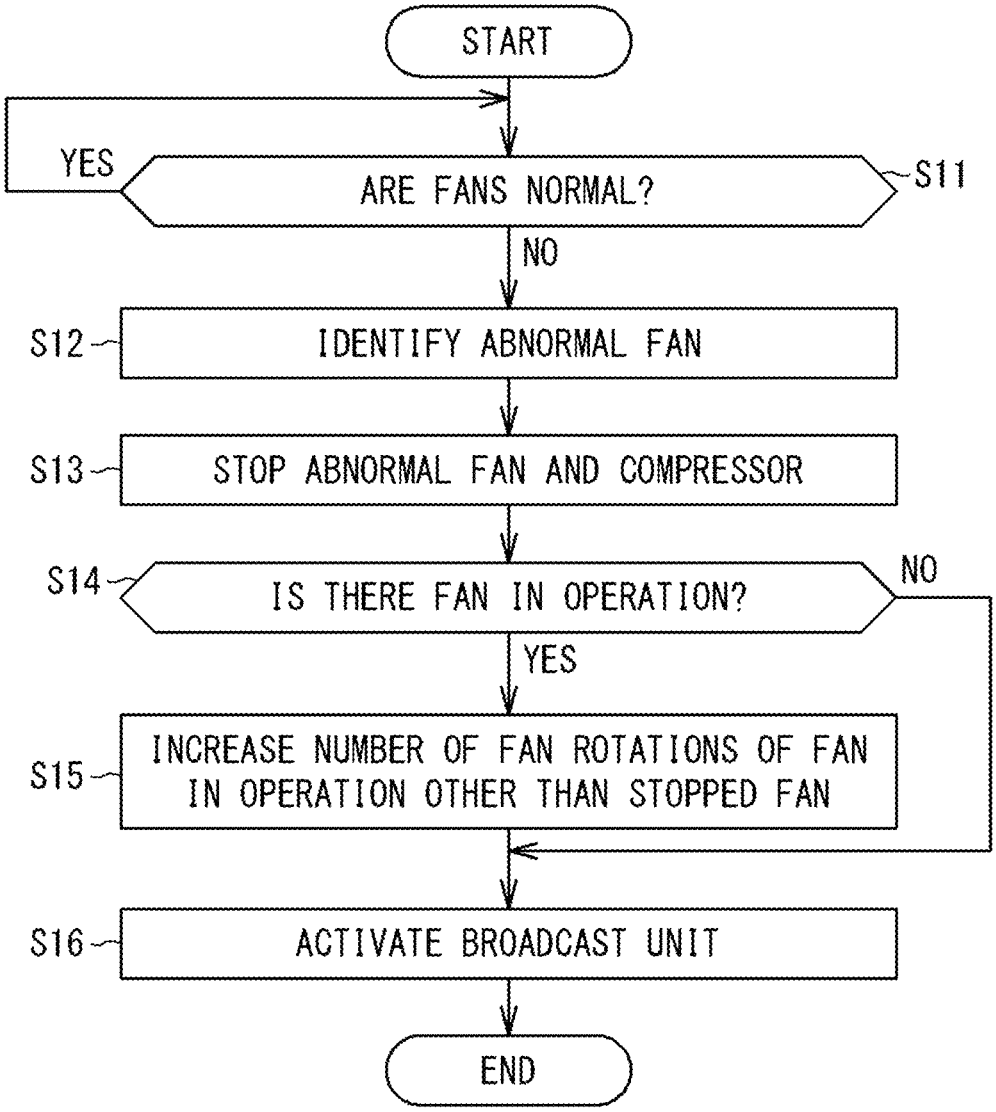
FIG. 4 is a second flowchart illustrating the operation when an abnormality occurs in the ventilation system of the present disclosure.

When the control unit 16 determines that there is a sign of abnormality occurrence in either the supply fan 22 or the exhaust fan 32, the notification unit 45 notifies the sign. The user can know a fan having a high possibility of occurrence of abnormality by the information presented by the notification unit 45. The user can repair the fans before an abnormality occurs in the supply fan 22 and the exhaust fan 32. The control unit 16 predicts occurrence of an abnormality in the supply fan 22 and the exhaust fan 32, and the notification unit 45 notifies the occurrence of the abnormality. Therefore, the ventilation system 10 of the present disclosure can suppress the occurrence of the abnormality that needs to be stopped during use and can continue to operate reliably. Control of ventilation system when abnormality occurs FIG. 3 is a first flowchart illustrating the operation when an abnormality occurs in the ventilation system of the present disclosure. FIG. 4 is a second flowchart illustrating the operation when an abnormality occurs in the ventilation system of the present disclosure. In the ventilation system 10 of the present disclosure, a control operation illustrated in FIG. 3 or FIG. 4 is executed when an abnormality occurs in the supply fan 22 and the exhaust fan 32.

First Control Operation

The control operation of the ventilation system 10 illustrated in FIG. 3 will be described. As illustrated in FIG. 3, when the operation of the ventilation system 10 is started, the control unit 16 determines whether the supply fan 22 and the exhaust fan 32 are normal (S01). In the present description, the control unit 16 determines that the supply fan 22 and the exhaust fan 32 are normal when there is no failure in the supply fan 22 and the exhaust fan 32 and the operation is performed in a state where the operation current values and the number of fan rotations are normal. In the present description, a state of the supply fan 22 not being normal is referred to as an abnormal state of the supply fan 22, and a state of the exhaust fan 32 not being normal is referred to as an abnormal state of the exhaust fan 32.

In step (S01), when the supply fan 22 and the exhaust fan 32 are normal (YES), the control unit 16 repeatedly executes step (S01). When determining in step (S01) that the supply fan 22 and the exhaust fan 32 are abnormal (NO), the control unit 16 executes step (S02).

In step (S02), the control unit 16 identifies an abnormal fan (the supply fan 22 or the exhaust fan 32) of the supply fan 22 or the exhaust fan 32, and proceeds to step (S03).

In step (S03), the control unit 16 stops the fan (the supply fan 22 or the exhaust fan 32) identified as being abnormal of the supply fan 22 or the exhaust fan 32, and proceeds to step (S04).

In step (S04), the control unit 16 determines whether there are the supply fan 22 and the exhaust fan 32 in operation. When determining in step (S04) that there are the supply fan 22 and the exhaust fan 32 in operation (YES), the control unit 16 executes step (S05). When determining in step (S04) that there is not the supply fan 22 and the exhaust fan 32 in operation (NO), the control unit 16 proceeds to step (S08).

In step (S05), the control unit 16 increases the number of fan rotations of the fan in operation other than the stopped fan (the supply fan 22 or the exhaust fan 32) of the supply fan 22 or the exhaust fan 32, and proceeds to step (S06). In the ventilation system 10 of the present disclosure, step (S05) may be omitted, and step (S06) may be executed after step (S04) is executed.

In step (S06), the control unit 16 activates the notification unit 45 to notify to the user that the abnormal fan (the supply fan 22 or the exhaust fan 32) has been stopped, and proceeds to step (S07).

In step (S07), the control unit 16 determines whether an abnormality of the refrigerant circuit 50 is normal. In the present description, a state of the refrigerant circuit 50 not being normal may be referred to as an abnormality of the refrigerant circuit 50. The "abnormality of the refrigerant circuit 50" herein means that the state value of the refrigerant circuit 50 exceeds the allowable range. When determining in step (S07) that the refrigerant circuit 50 is normal (YES), the control unit 16 repeatedly executes step (S07) at predetermined time intervals to continuously check whether the refrigerant circuit 50 is normal. When determining in step (S07) that the refrigerant circuit 50 is abnormal (NO), the control unit 16 executes step (S08).

In step (S08), the control unit 16 stops the compressor 42 to protect the refrigerant circuit 50, and proceeds to step (S09).

In step (S09), the control unit 16 activates the notification unit 45 to notify to the user that the compressor 42 has been stopped, and ends the series of control operations. When the determination in step (S04) is NO and the processing proceeds from step (S04) to step (S08), the control unit 16 causes the notification unit 45 to notify that the fans 22 and 32 and the compressor 42 have been stopped in step (S09). As long as there are the supply fan 22 and the exhaust fan 32 in operation, the control unit 16 continues the control of the ventilation system 10 in accordance with the flowchart illustrated in FIG. 3.

By performing control according to the flow illustrated in FIG. 3, the ventilation system 10 can continue ventilation of the indoor space S1 even when an abnormality occurs in the supply fan 22 or the exhaust fan 32. When no abnormality occurs in the refrigerant circuit 50, the ventilation system 10 can further continue the operation of the compressor 42. In this case, temperature adjustment of the supply air SA or heat recovery from the exhaust air EA by the refrigerant circuit 50 can be continued by exerting the function of the fan (the supply fan 22 or the exhaust fan 32) in which no abnormality has occurred. By performing control in accordance with the flow illustrated in FIG. 3, the ventilation system 10 can suppress a decrease in a degree of comfort and a heat recovery efficiency of the indoor space S1 even when an abnormality occurs in the supply fan 22 or the exhaust fan 32.

The ventilation system 10 of the present disclosure may perform control in accordance with the flow illustrated in FIG. 4 when an abnormality occurs in the supply fan 22 and the exhaust fan 32.

Here, the control operation of the ventilation system 10 illustrated in FIG. 4 will be described. As illustrated in FIG. 4, when the operation of the ventilation system 10 is started, the control unit 16 determines whether the supply fan 22 and the exhaust fan 32 are normal (S11). In step (S11), when the supply fan 22 and the exhaust fan 32 are normal (YES), the control unit 16 repeatedly executes step (S11). When determining in step (S11) that the supply fan 22 and the exhaust fan 32 are abnormal (NO), the control unit 16 executes step (S12).

In step (S12), the control unit 16 identifies an abnormal fan of the supply fan 22 or the exhaust fan 32, and proceeds to step (S13).

In step (S13), the control unit 16 stops the fan identified as being abnormal of the supply fan 22 or the exhaust fan 32, stops the compressor 42, and proceeds to step (S14).

In step (S14), the control unit 16 determines whether there are the supply fan 22 and the exhaust fan 32 in operation. When determining in step (S14) that there are the supply fan 22 and the exhaust fan 32 in operation (YES), the control unit 16 executes step (S15). When determining in step (S14) that there is not the supply fan 22 and the exhaust fan 32 in operation (NO), the control unit 16 proceeds to step (S16).

In step (S15), the control unit 16 increases the number of fan rotations of the fan in operation other than the stopped fan (the supply fan 22 or the exhaust fan 32) of the supply fan 22 or the exhaust fan 32, and proceeds to step (S16). In the ventilation system 10 of the present disclosure, step (S15) may be omitted, and step (S16) may be executed after step (S14) is executed.

In step (S16), the control unit 16 activates the notification unit 45 to notify to the user that the abnormal fan (the supply fan 22 or the exhaust fan 32) and the compressor 42 have been stopped, and ends the series of control operations (END). As long as there are the supply fan 22 and the exhaust fan 32 in operation, the control unit 16 continues the control of the ventilation system 10 in accordance with the flowchart illustrated in FIG. 4.

First Ventilation System 11

Figure 5:
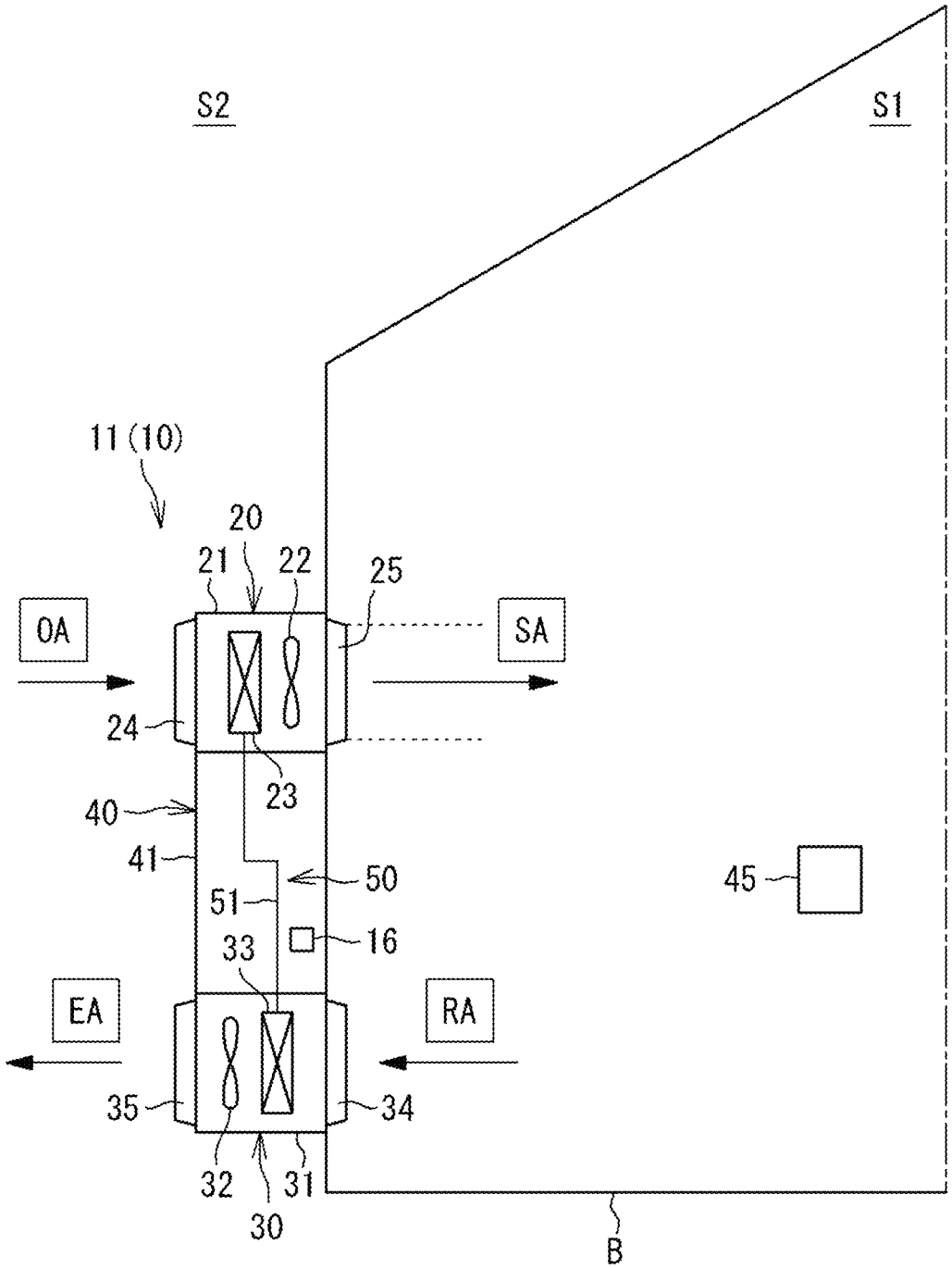
FIG. 5 is a schematic configuration diagram illustrating an arrangement state of a ventilation system according to a first embodiment of the present disclosure on a building.
Figure 6:
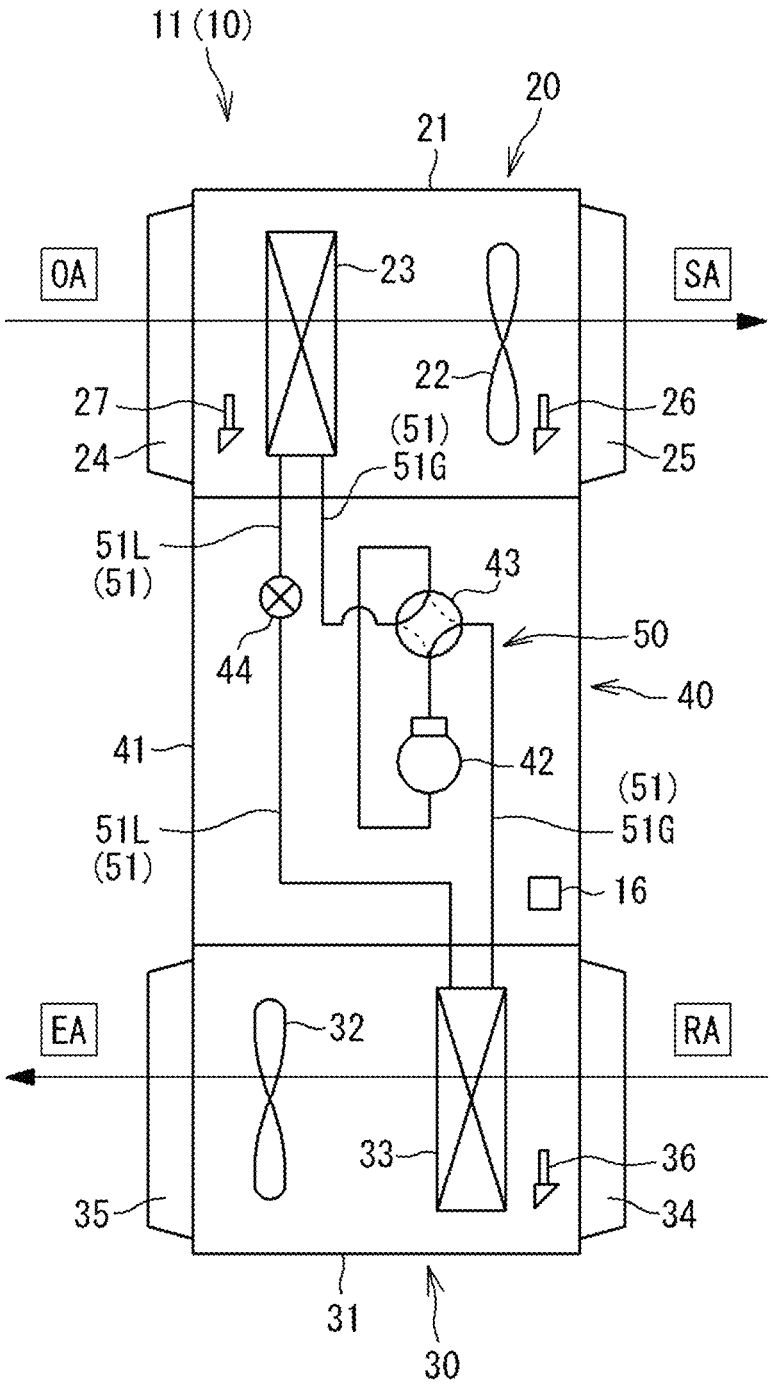
FIG. 6 is a schematic configuration diagram of the ventilation system according to the first embodiment of the present disclosure.

FIG. 5 is a schematic configuration diagram illustrating an arrangement state of the ventilation system according to the first embodiment of the present disclosure on a building. FIG. 6 is a schematic configuration diagram of the ventilation system according to the first embodiment of the present disclosure. The first ventilation system 11 illustrated in FIG. 5 and FIG. 6 is the first embodiment of the ventilation system 10 of the present disclosure. The first ventilation system 11 includes one supply unit 20, one exhaust unit 30, a compressor unit 40, and a refrigerant circuit 50. In other words, in the first ventilation system 11, the supply unit 20 and the exhaust unit 30 correspond to each other on a one-to-one basis. In a mode illustrated in FIG. 5 and FIG. 6, the supply unit 20, the exhaust unit 30, and the compressor unit 40 are integrally configured in the first ventilation system 11, but the units 20, 30, and 40 can be separated, and can be disposed separately. In the following description, parts common to the first and second ventilation systems 11 and 12 are denoted by the same reference signs, and description of the parts denoted by the same reference signs will not be repeated.

As illustrated in FIG. 5, the first ventilation system 11 can be disposed in the outdoor space S2, for example. In the present embodiment, the blow-out port 25 of the supply unit 20 and the suction port 34 of the exhaust unit 30 are attached directly to an outer wall surface of a building B. In the first ventilation system 11, a duct may be connected to the blow-out port 25 and the suction port 34 to be able to adjust a position where the supply air SA is released to the indoor space S1 and a position where the return air RA is sucked from the indoor space S1. In the present embodiment, a case where the first ventilation system 11 is disposed in the outdoor space S2 is exemplified. However, the entire first ventilation system 11 may be disposed in the indoor space S1, or the supply unit 20, the exhaust unit 30, and the compressor unit 40 may be separated, some of the units may be disposed in the outdoor space S2, and the other units may be disposed in the indoor space S1.

Here, a case will be described where the first ventilation system 11 is controlled in accordance with the flow illustrated in FIG. 3. When determining that the supply fan 22 or the exhaust fan 32 is abnormal during the operation of the first ventilation system 11 (S01), the control unit 16 identifies the abnormal fan (S02), and stops the abnormal fan (the supply fan 22 or the exhaust fan 32) (S03). When the stopped fan is the supply fan 22, the control unit 16 continues the operation of the exhaust fan 32. In this case, the first ventilation system 11 can continue ventilation (third ventilation) with only the exhaust fan 32 for the indoor space S1. When the stopped fan is the exhaust fan 32, the control unit 16 continues the operation of the supply fan 22. In this case, the first ventilation system 11 can continue ventilation (second ventilation) with only the supply fan 22 for the indoor space S1.

After stopping the abnormal fan (the supply fan 22 or the exhaust fan 32), the control unit 16 increases the number of fan rotations of the fan (the supply fan 22 or the exhaust fan 32) that is continuing the operation to increase an air volume of the fan (S05). Thus, the first ventilation system 11 can suppress a decrease in a ventilation amount of the indoor space S1 due to the stop of the supply fan 22 or the exhaust fan 32.

After stopping the abnormal fan (the supply fan 22 or the exhaust fan 32), the control unit 16 activates the notification unit 45 disposed in the indoor space S1 to notify to the user or the like that the supply fan 22 or the exhaust fan 32 has been stopped (S06). By the activation of the notification unit 45 at this time, the user can know that a change has occurred in the ventilation state of the indoor space S1.

After stopping the abnormal fan (the supply fan 22 or the exhaust fan 32) and acquiring the state value of the refrigerant circuit 50, when determining that the state value exceeds the allowable range, the control unit 16 stops the compressor 42 (S08). In the first ventilation system 11, when an abnormality occurs in the supply fan 22 or the exhaust fan 32, it is possible to continue ventilation of the indoor space S1 while performing heat exchange and heat recovery by the refrigerant circuit 50 as much as possible.

After stopping the refrigerant circuit 50, the control unit 16 activates the notification unit 45 to notify to the user or the like that the compressor 42 has stopped (S09). By the activation of the notification unit 45 at this time, the user can know that there is a possibility that a change occurs in the temperature of the indoor space S1.

Here, a case will be described where the first ventilation system 11 is controlled in accordance with the flow illustrated in FIG. 4. When determining that the supply fan 22 or the exhaust fan 32 is abnormal during the operation of the first ventilation system 11 (S11), the control unit 16 identifies the abnormal fan (S12), and stops the abnormal fan (the supply fan 22 or the exhaust fan 32) and the compressor 42 (S13).

When the first ventilation system 11 is controlled in accordance with the flowchart illustrated in FIG. 4, ventilation of the indoor space S1 can be reliably continued in a case where an abnormality occurs in the supply fan 22 or the exhaust fan 32.

Second Ventilation System

Figure 7:
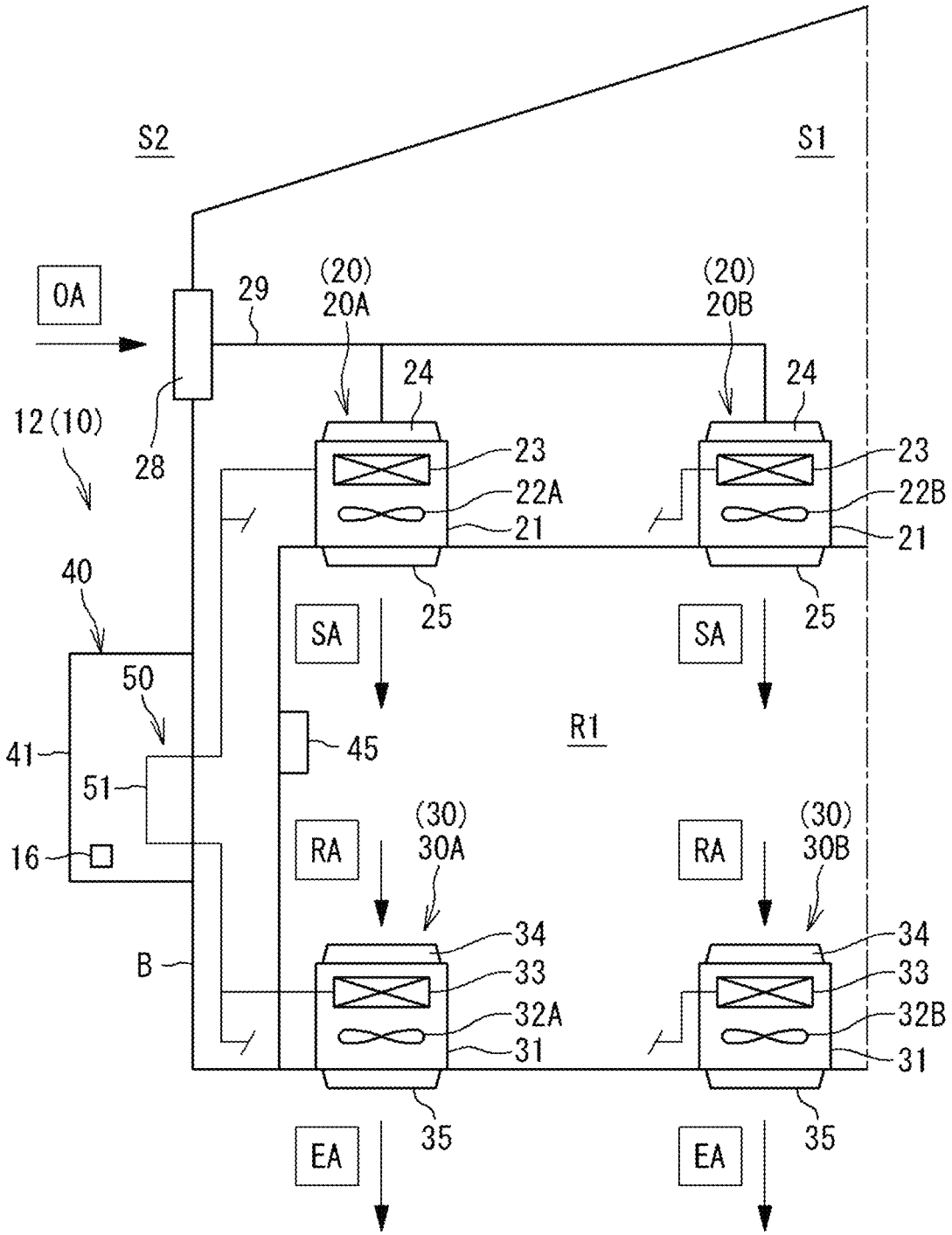
FIG. 7 is a schematic configuration diagram of a ventilation system according to a second embodiment of the present disclosure.

FIG. 7 is a schematic configuration diagram of the ventilation system according to the second embodiment of the present disclosure. The second ventilation system 12 illustrated in FIG. 7 is the second embodiment of the ventilation system 10 of the present disclosure. The second ventilation system 12 is different from the first ventilation system 11 described above in that a plurality of supply units 20 and a plurality of exhaust units 30 are provided.

As illustrated in FIG. 7, the second ventilation system 12 ventilates a room R1 provided in the indoor space S1. The second ventilation system 12 includes two supply units 20 and two exhaust units 30 for the room R1. In the following description, one of the two supply units 20 is referred to as a first supply unit 20A, the other supply unit 20 is referred to as a second supply unit 20B, one of the two exhaust units 30 is referred to as a first exhaust unit 30A, and the other exhaust unit 30 is referred to as a second exhaust unit 30B. The first supply unit 20A includes a first supply fan 22A, and the second supply unit 20B includes a second supply fan 22B. The first exhaust unit 30A includes a first exhaust fan 32A, and the second exhaust unit 30B includes a second exhaust fan 32B. Although the second ventilation system 12 according to the present embodiment includes two supply units 20 and two exhaust units 30, the number of the supply units 20 and the number of the exhaust units 30 in the second ventilation system 12 are not limited to two, and may be two or more, or one of the numbers may be one. In the second ventilation system 12 according to the present embodiment, the number of supply units 20 and the number of exhaust units 30 may be different.

In the second ventilation system 12, the outside air OA taken in from an outside air inlet 28 provided in the outer wall of the building B is distributed to the supply units 20A and 20B by a supply duct 29. In the second ventilation system 12, the plurality of supply fans 22 supplies the supply air SA to the room R1, and the plurality of exhaust fans 32 releases the return air RA having a volume balanced with a volume of the supply air SA from the room R1 as the exhaust air EA. In the second ventilation system 12, a total air volume of the supply air SA by the plurality of supply units 20 and a total air volume of the exhaust air EA by the plurality of exhaust units 30 are balanced.

Here, a case will be described where the second ventilation system 12 is controlled in accordance with the flow illustrated in FIG. 3. In the following description, a description will be mainly given of a part different in operation from a case where the first ventilation system 11 is controlled in accordance with the flow illustrated in FIG. 3, and a description of a part common in operation will be omitted.

When determining that any of the first supply fan 22A, the second supply fan 22B, the first exhaust fan 32A, or the second exhaust fan 32B (S01) is abnormal during the operation of the second ventilation system 12, the control unit 16 identifies a fan having an abnormality (S02) and stops the abnormal fan (S03). For example, when the stopped fan is the first supply fan 22A, the control unit 16 continues the operation of the second supply fan 22B, the first exhaust fan 32A, and the second exhaust fan 32B. In this case, the first ventilation system 11 can continue ventilation (first ventilation) for the indoor space S1. In the second ventilation system 12, even when any of the fans is stopped, it is possible to continue the ventilation of the indoor space S1 (first ventilation) by continuing the operation of the remaining fans.

For example, when the stopped fan is the first supply fan 22A, the control unit 16 increases the number of fan rotations of the second supply fan 22B of the fans continuing the operation to increase a supply amount of the second supply fan 22B. By bringing a balance between the supply amount and the discharge amount close to a normal state, the first ventilation system 11 can suppress a decrease in the ventilation amount of the indoor space S1 due to the stop of the first supply fan 22A. In the second ventilation system 12, when the first supply fan 22A is stopped, the number of fan rotations of not only the second supply fan 22B but also the numbers of fan rotations of the first exhaust fan 32A and the second exhaust fan 32B may be further increased. In other words, in the second ventilation system 12, when any fan is stopped, the numbers of fan rotations of all the remaining fans may be increased to suppress a decrease in the ventilation amount of the indoor space S1.

Here, a case will be described where the second ventilation system 12 is controlled in accordance with the flow illustrated in FIG. 4. When determining that any of the first supply fan 22A, the second supply fan 22B, the first exhaust fan 32A, or the second exhaust fan 32B (S11) is abnormal during the operation of the second ventilation system 12, the control unit 16 identifies a fan having an abnormality (S12) and stops the abnormal fan and the compressor 42 (S13). When the stopped fan is the first supply fan 22A, the control unit 16 continues the operation of the second supply fan 22B, the first exhaust fan 32A, and the second exhaust fan 32B. In this case, the second ventilation system 12 can continue ventilation (first ventilation) with the second supply fan 22B, the first exhaust fan 32A, and the second exhaust fan 32B for the indoor space S1.

When the second ventilation system 12 is controlled in accordance with the flowchart illustrated in FIG. 4, ventilation of the indoor space S1 can be reliably continued in a case where an abnormality occurs in any of the first supply fan 22A, the second supply fan 22B, the first exhaust fan 32A, or the second exhaust fan 32B.

Functional Effects of Embodiments (1) The first ventilation system 11 described in the above embodiment includes the refrigerant circuit 50 in which the compressor 42, the first heat exchanger 23, and the second heat exchanger 33 are connected by the refrigerant pipe 51 and the refrigerant flows, the supply fan 22 that supplies air in the outdoor space S2 to the indoor space S1 through the first heat exchanger 23, the exhaust fan 32 that exhausts air in the indoor space S1 to the outdoor space S2 through the second heat exchanger 33, and the control unit 16. The control unit 16 determines whether the supply fan 22 and the exhaust fan 32 are normal. When determining that one of the supply fan 22 or the exhaust fan 32 is abnormal, the control unit 16 stops the one of the supply fan 22 or the exhaust fan 32 determined to be abnormal and continues an operation of another one of the supply fan 22 or the exhaust fan 32 determined to be normal.

In this case, the ventilation system 10 including the refrigerant circuit 50, the supply fan 22, and the exhaust fan 32 can continue the ventilation of the indoor space S1 when an abnormality occurs in the supply fan 22 or the exhaust fan 32.

(2) In the ventilation system 10 described in the above embodiment, the control unit 16 acquires a state value of the refrigerant circuit 50, and when determining that the state value exceeds an allowable range, the control unit 16 stops the compressor 42.

In the ventilation system 10 having such a configuration, when an abnormality occurs in the supply fan 22 or the exhaust fan 32, it is possible to continue ventilation of the indoor space S1 while performing heat exchange and heat recovery by the refrigerant circuit 50 as much as possible.

(3) In the ventilation system 10 described in the above embodiment, when determining that the supply fan 22 or the exhaust fan 32 is abnormal, the control unit 16 stops the compressor 42.

In the ventilation system 10 having such a configuration, the ventilation of the indoor space S1 can be reliably continued in a case where an abnormality occurs in the supply fan 22 or the exhaust fan 32.

(4) The ventilation system 10 described in the above embodiment further includes the notification unit 45 that notifies an abnormality of the supply fan 22 or the exhaust fan 32. When determining that the supply fan 22 or the exhaust fan 32 is abnormal, the control unit 16 activates the notification unit 45.

In the ventilation system 10 having such a configuration, the notification unit 45 can notify to a user or the like occurrence of the abnormality in the supply fan 22 or the exhaust fan 32.

(5) In the ventilation system 10 described in the above embodiment, the control unit 16 determines whether the supply fan 22 is normal on the basis of a correlation between the number of fan rotations and the operation current value of the supply fan 22, and determines whether the exhaust fan 32 is normal on the basis of a correlation between the number of fan rotations and the operation current value of the exhaust fan 32.

The ventilation system 10 having such a configuration allows the control unit 16 to determine whether the supply fan 22 or the exhaust fan 32 is abnormal without a sensor provided separately.

(6) In the first ventilation system 11 described in the above embodiment, when determining that one of the supply fan 22 or the exhaust fan 32 is abnormal, the control unit 16 increases the number of fan rotations of the another one of the supply fan 22 or the exhaust fan 32 determined to be normal.

The first ventilation system 11 having such a configuration can suppress a decrease in the ventilation amount of the indoor space S1 when the supply fan 22 or the exhaust fan 32 in which the abnormality has occurred is stopped.

(7) In the second ventilation system 12 described in the above embodiment, the supply fan 22 includes the first supply fan 22A and the second supply fan 22B, and the exhaust fan 32 includes the first exhaust fan 32A and the second exhaust fan 32B. The control unit 16 determines whether the first supply fan 22A, the second supply fan 22B, the first exhaust fan 32A, and the second exhaust fan 32B are normal, and continues the operation of the remaining the supply fan 22 or the exhaust fan 32 determined to be normal when determining that any one of the supply fan 22 or the exhaust fan 32 is abnormal.

In this case, the second ventilation system 12 including the refrigerant circuit 50 and a plurality of supply fans 22 and exhaust fans 32 can continue the ventilation of the indoor space S1 when an abnormality occurs in the supply fans 22 or the exhaust fans 32.

(8) In the second ventilation system 12 described in the above embodiment, when determining that any one of the first supply fan 22A, the second supply fan 22B, the first exhaust fan 32A, or the second exhaust fan 32B is abnormal, the control unit 16 increases the number of fan rotations of the supply fan 22 or the exhaust fan 32 determined to be normal.

The ventilation system 10 having such a configuration can suppress a decrease in the ventilation amount of the indoor space S1 when the supply fan 22 or the exhaust fan 32 in which the abnormality has occurred is stopped.

(9) In the ventilation system 10 described in the above embodiment, the control unit 16 predicts an abnormality of the supply fan 22 on the basis of operation data of the supply fan 22 and predicts an abnormality of the exhaust fan 32 on the basis of operation data of the exhaust fan 32.

The ventilation system 10 having such a configuration can perform preventive maintenance on the supply fan 22 and the exhaust fan 32 before occurrence of abnormality and can suppress occurrence of abnormality in the supply fan 22 or the exhaust fan 32 during operation. As a result, the ventilation amount of the indoor space S1 can be reliably secured.

The present disclosure should not be limited to the above exemplification, but is intended to include any modification recited in the claims within meanings and a scope equivalent to those of the claims.

The invention claimed is:

1. A ventilation system comprising:

a refrigerant circuit having a compressor, a first heat exchanger, and a second heat exchanger connected by a refrigerant pipe with a refrigerant flowing therein;

a supply fan arranged to supply air from an outdoor space to an indoor space through the first heat exchanger;

an exhaust fan arranged to exhaust air from the indoor space to the outdoor space through the second heat exchanger; and a control unit including a processor, the control unit being configured to determine whether the supply fan and the exhaust fan are normal, and upon determining that one of the supply fan or the exhaust fan is abnormal, stop the one of the supply fan or the exhaust fan determined to be abnormal, and continue an operation of an other one of the supply fan or the exhaust fan determined to be normal.

2. The ventilation system according to claim 1, wherein the control unit is further configured to acquire a state value of the refrigerant circuit, and upon determining that the state value exceeds an allowable range, stop the compressor.

3. The ventilation system according to claim 1, wherein upon determining that the supply fan or the exhaust fan is abnormal, the control unit is configured to stop the compressor.

4. The ventilation system according to claim 1, further comprising:

a notification unit including at least one of a display and a speaker, the notification unit being configured to notify of an abnormality of the supply fan or the exhaust fan, upon determining that the supply fan or the exhaust fan is abnormal, the control unit being configured to activate the notification unit.

5. The ventilation system according to claim 1, wherein the control unit is configured to determine whether the supply fan is normal based on a correlation between a number of fan rotations and an operation current value of the supply fan, and determine whether the exhaust fan is normal based on a correlation between a number of fan rotations and an operation current value of the exhaust fan.

6. The ventilation system according to claim 1, wherein upon determining that one of the supply fan or the exhaust fan is abnormal, the control unit being configured to increase a number of fan rotations of an other one of the supply fan or the exhaust fan determined to be normal.

7. The ventilation system according to claim 1, wherein the supply fan includes a first supply fan and a second supply fan, the exhaust fan includes a first exhaust fan and a second exhaust fan, the control unit is configured to determine whether the first supply fan, the second supply fan, the first exhaust fan, and the second exhaust fan are normal, and upon determining that any one of the supply fan or the exhaust fan is abnormal, continue an operation of a remaining one of the supply fan or the exhaust fan determined to be normal.

8. The ventilation system according to claim 7, wherein upon determining that any one of the first supply fan, the second supply fan, the first exhaust fan, or the second exhaust fan is abnormal, the control unit is configured to increase a number of fan rotations of the supply fan or the exhaust fan determined to be normal.

9. The ventilation system according to claim 1, wherein the control unit is further configured to predict an abnormality of the supply fan based on operation data of the supply fan, and predict an abnormality of the exhaust fan based on operation data of the exhaust fan.

* * * * *